US005309992A

United States Patent [19]

Watson

[11] Patent Number: 5,309,992

[45] Date of Patent: May 10, 1994

[54] PULLEY-DRIVE LIFTING SYSTEM

[75] Inventor: Jerry L. Watson, Odessa, Tex.

[73] Assignee: Evi-Highland Pump Company, Inc., Odessa, Tex.

[21] Appl. No.: 725,200

[22] Filed: Jul. 3, 1991

[51] Int. Cl.[5] ..... E21B 43/00

[52] U.S. Cl. ..... 166/68.5; 166/77.5; 74/41; 74/61; 74/89.2

[58] Field of Search ..... 166/68.5; 74/37, 41, 74/61, 89.2; 417/362, 218

[56] References Cited

U.S. PATENT DOCUMENTS

| | | | |
|---|---|---|---|
| 1,277,382 | 9/1918 | Chapman | 74/41 |
| 1,756,089 | 4/1930 | Hunter | 74/37 |
| 2,555,574 | 6/1951 | Crawford | 74/37 |
| 2,874,641 | 2/1959 | McCandlish et al. | 166/68.5 |
| 3,248,958 | 5/1966 | Bender | 74/89.2 |
| 3,345,950 | 10/1967 | Bender | 193/206 |
| 3,483,828 | 12/1969 | Bender | 103/206 |
| 3,515,008 | 6/1970 | Davidescu et al. | 74/37 |
| 3,538,777 | 11/1970 | Bender | 74/37 |
| 3,777,491 | 12/1973 | Bender | 60/372 |
| 3,792,836 | 2/1974 | Bender | 254/139 |
| 4,161,137 | 7/1979 | Paddy | 74/66 |
| 4,249,376 | 2/1981 | Weckerly | 166/68.5 |
| 4,320,799 | 3/1982 | Gilbertson | 166/68.5 |
| 4,391,155 | 7/1983 | Bender | 74/89.2 |
| 4,519,262 | 5/1985 | Le et al. | 74/89.2 |
| 4,651,582 | 3/1987 | Bender | 74/89.22 |
| 4,665,761 | 5/1987 | Bao | 74/41 |
| 4,916,959 | 4/1990 | Lively | 74/37 |
| 5,018,350 | 5/1991 | Bender | 60/369 |

*Primary Examiner*—Ramon S. Britts
*Assistant Examiner*—Frank S. Tsay
*Attorney, Agent, or Firm*—Steven G. Lisa; Peter C. Warner

[57] ABSTRACT

An improved lifting system is disclosed for pumping liquid such as oil from a subterranean pump using a band-and-pulley assembly. The device uses a single-piece band shaped in the form of an elongated loop. Both intermediate lengths of the looped band are draped together over a rotating pulley assembly mounted near the top of a derrick. The loop formed by one end of the band supports a first end-roller assembly coupled to the polished rod assembly, which is in turn coupled to the subterranean pump. The loop formed by the other end of the band supports a second end-roller assembly coupled to the counterweight assembly The counterweight assembly is reciprocated vertically by a drive motor, thereby driving the intermediate lengths of the band over the top, supporting pulley. The end rollers have sufficient diameter and rotational freedom to permit movement of the band, and the bearing of great weights, without damaging the band.

11 Claims, 7 Drawing Sheets

PULLEY-DRIVE LIFTING SYSTEM

BACKGROUND OF THE INVENTION

This invention relates to an improved pumping unit using a band-and-pulley lifting system rather than the common rocker-arm or walking-beam system. U.S. Pat. No. 4,916,959, issued on Apr. 17, 1990, to Gordon R. Lively, discloses a belt-and-pulley lifting system similar to the type that is the subject of this application, and is incorporated herein by reference.

Prior belt-and-pulley lifting systems, including the preferred form disclosed in U.S. Pat. No. 4,916,959, employ a flat belt that is coupled at one end to a counterweight assembly and at the other end to a polished rod assembly. The polished rod assembly is coupled, through the polished rod and a rod string, to the downhole pump. The counterweight assembly is in turn coupled to a drive system that drives the belt over a roller pulley assembly located near the top of the derrick structure.

The type of belt-and-pulley system described above has the significant advantage of being able to lift great loads efficiently, thereby improving oil-well pumping operations. Specifically, the belt, and the associated counterweight and polished rod assemblies, each have the capacity to bear great loads. However, there was previously no equally strong means for fastening the respective ends of the belt to the counterweight and polished rod assemblies. The system shown in U.S. Pat. No. 4,916,959 employed a series of plates that riveted or otherwise fastened the ends of the belt to the counterweight and polished rod assemblies Such fasteners are much weaker than either the belt or the counterweight and polished rod assemblies and are not capable of bearing the significant weight or stress carried by the overall system. As a result, the use of fasteners of the type disclosed in the prior art caused many failures and severely limited the overall capacity of the system.

The need exists, therefore, for an improved pulley-lifting system that eliminates the need for weak-link fasteners between the belt, or band, and the end assemblies it carries, therefore increasing the overall capacity and efficiency of the system.

SUMMARY OF THE INVENTION

It is a primary object of this invention, therefore, to provide an improved band-drive lifting system having the capacity to lift heavier loads, including improved means for coupling the counterweight and polished rod assemblies to the band.

It is further an object of this invention to provide a band-drive lifting system that permits reduced stress on the parts supporting the heavy weights used in deep-well pumping.

It is further an object of this invention to permit the use of a thinner or narrower endless-loop band to support the same, or even increased, loads, as compared to the belt used in prior belt-and-pulley systems.

It is further an object of this invention to provide a band-drive lifting system achieving the same advantages described in U.S. Pat. No. 4,916,959, incorporated above, including greater efficiency, lower counterweight weight, longer pumping strokes, smaller and more compact drive motor, reduced shock and vibration, smoother acceleration and deceleration, and the benefits those advantages permit in reduced power, increased recovery, etc., while at the same tim®providing improved capacity of the overall system by removing the need for low- load-capacity fasteners.

The above and other objects are accomplished in a band-and-pulley lifting system through use of a single-piece band shaped in the form of a loop, rather than a belt shaped as a strip. Both intermediate lengths of the looped band are draped together over a central pulley assembly, or bearing, mounted at or near the top of the derrick structure. The loop at one end of the band is coupled to and supports a first end-roller assembly mounted on a polished rod coupling assembly, which is in turn connected to the polished rod assembly The polished rod assembly and the associated sucker rod string extends down the well hole to the subterranean pump. The loop at the other end of the band is coupled to and supports a second end-roller assembly mounted on a counterweight coupling assembly, which in turn is coupled to the counterweight assembly. The counterweight assembly is coupled to the drive assembly. The counterweight assembly is reciprocated vertically by the drive motor and a chain-and-sprocket assembly, thereby driving the band over the central pulley assembly. Band shafts in the two end-roller assemblies have sufficient diameter and rotational freedom to permit movement relative to the band without damaging either those rollers or the band. No fasteners are needed to attach the band to the end assemblies, thereby eliminating the weak fasteners of the prior art.

The above and other objects are also accomplished by using a looped band and multiple pulley assembly to increase the overall capacity of a band-and-pulley lifting system. BY providing a looped band of a given thickness and width, which is draped over the central pulley assembly located at or near the top of the derrick structure, more weight can be carried than the prior art systems, which employed a single-length belt of greater thickness or width fastened at its ends to the counterweight and polished rod assemblies. Moreover, by using a looped band, the closed loop ends can be employed for bearing the counterweight and polished rod assemblies, thereby avoiding the weak connections of the prior art. A roller assembly at each of the closed loop ends of the band permit the two sides of the loop ends to move relative to one another as the band travels over the top pulley assembly.

Other aspects of the invention will be appreciated by those skilled in the art after a reading of the detailed disclosure of the present invention below.

DESCRIPTION OF THE DRAWINGS

The novel features of this invention are described with particularity in the claims. The invention, together with its objects and advantages, are better understood after referring to the following description and accompanying figures. Throughout the figures, the same reference numerals refer to the same elements.

DETAILED DESCRIPTION

The system of U.S. Pat. No. 4,916,959

A belt-and-pulley lifting system of the type disclosed in U.S. Pat. No. 4,916,959 is shown generally in FIGS. 1 and 2 of the present specification. For clarity and convenience, where possible, the same numerals for the same elements of the figures of U.S. Pat. No. 4,916,959 have been carried forward to the present specification.

Figure 1:
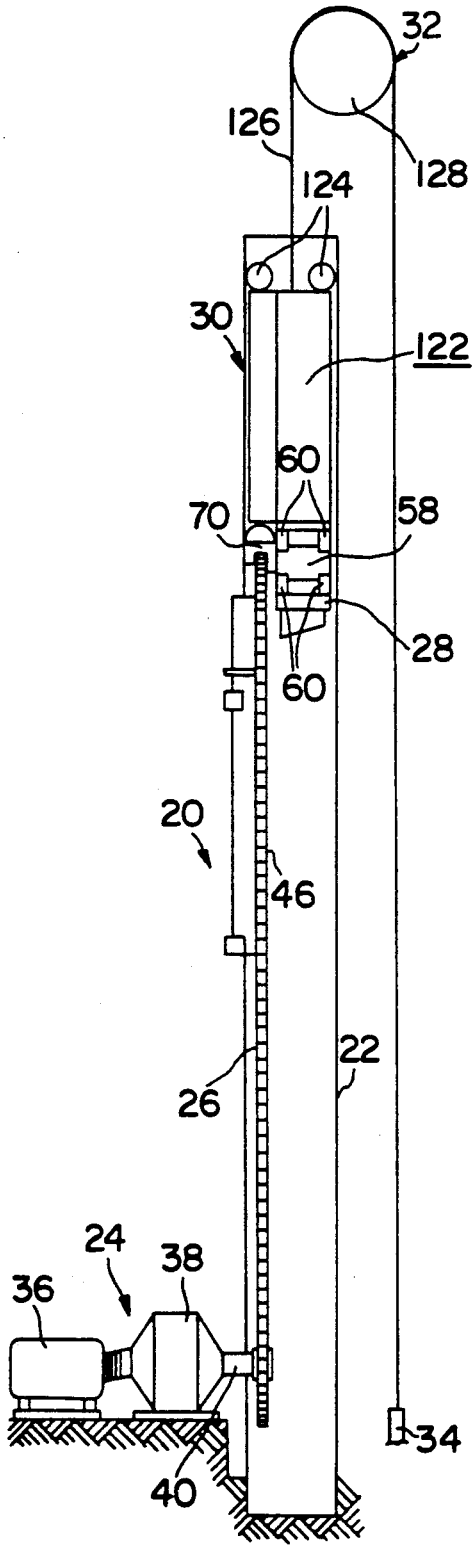
FIG. 1 depicts in simplified schematic form a side view of one embodiment of a typical belt-and-pulley apparatus, with the counterweight assembly shown in the up position.
Figure 2:
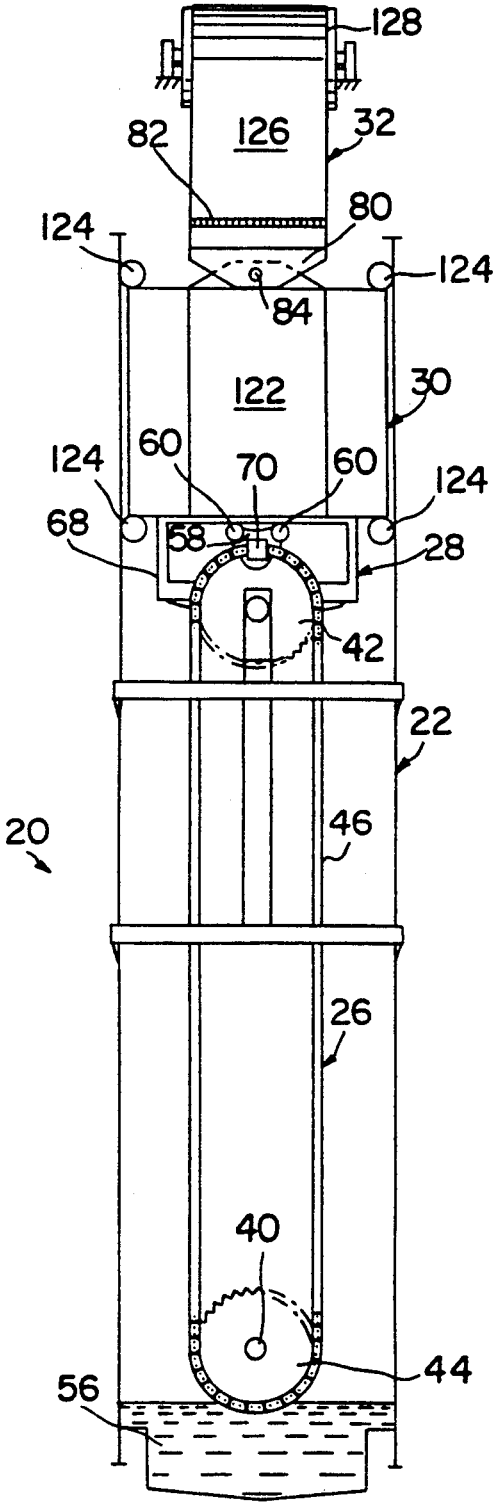
FIG. 2 depicts in simplified schematic form a rear view of the device of FIG. 1.

Referring to FIGS. 1 and 2, a well lifting unit 20 is illustrated that includes derrick structure 22, drive motor assembly 24, chain-and-sprocket assembly 26, carriage assembly 28, counterweight assembly 30, and belt-and-pulley assembly 32. Well lifting unit 20 is designed to operate a polished rod coupling assembly, shown generally by box 34. Polished rod coupling assembly 34 typically comprises a bridle bar (not shown) connected by a cable to a polished rod (not shown), which is in turn connected to the down-hole pump (not shown).

Derrick structure 22 is of a type common in the well pumping industry, and is not illustrated in detail in the Figures. Derrick structure 22 includes many upright members and frame support members that provide a stable framework to support the various other elements of well lifting unit 20. Derrick structure 22 also includes lubricating bath 56, into which chain-and-sprocket assembly 26 dips. Lubricating oil is provided in bath 56 in a quantity such that chain 46 is continuously lubricated as it orbits around sprockets 42 and 44.

Drive motor assembly 24 includes drive motor 36, gear box 38, and output shaft 40. Drive motor 36 operates gears located in gear box 38 to rotate output shaft 40. Thus, the output from drive motor assembly 24 is the rotation of output shaft 40. Chain-and-sprocket assembly 26 includes upper sprocket 42, lower sprocket 44, and endless chain 46. Lower sprocket 44 is coupled to output shaft 40 and thus is driven rotationally as shaft 40 rotates. Upper sprocket 42 is an idler sprocket. Other suitable forms of driven systems can be substituted for chain-and-sprocket assembly 26.

Counterweight assembly 30 includes counterweight 122 and various wheels 124. Counterweight 122 is of any shape, although a rectangular, box shape is illustrated in the Figures. The weight of counterweight 122 may be adjusted depending on the weight of the polish rod assembly, the depth of the well, etc., to achieve maximum efficiency from well pumping unit 20. The wheels 124 are rotatably coupled to, and may be positioned at the eight corners of, the counterweight 122. Wheels 124 engage derrick structure 22 to guide counterweight 122 within derrick structure 22 as well pumping unit 20 operates.

In the system of U.S. Pat. No. 4,916,949, and as shown in FIGS. 1 and 2, the belt-and-pulley assembly 32 includes belt 126 and pulley 128. Belt 126 engages pulley 128, which is an idler pulley attached at or near the top of derrick structure 22. A coupling assembly 80 is fastened by a row of connector plates 82 to one end of belt 126. Typically, connector plates 82 are riveted to belt 126 and to coupling assembly 80. Coupling assembly 80 is in turn rotatably attached to the top of counterweight assembly 30 by a pin 84. The other end of belt 126 is connected via a similar coupling assembly and associated connector plates (not shown) to polished rod coupling assembly 34.

Endless chain 46 is engaged and driven by lower sprocket 44. Upper sprocket 42 is an idler sprocket, which is driven by chain 46. Thus, as drive motor 36 operates, endless chain 46 is driven in an orbital loop around sprockets 42 and 44. Block base 58 is mounted on rolling devices, such as wheels 60, in carriage assembly 28, and is attached to endless chain 46 by swivel knuckle 70. Thus, block base 58 travels in an orbital loop around sprockets 42 and 44 with endless chain 46. In the preferred embodiment, a wheel 60 may be rotatably attached to the eight corners of block base 58, and engage rails (not shown) in frame 68. As block base 58 moves in the orbital loop around sprockets 42 and 44, block base 58 and wheels 60 move horizontally with respect to and within frame 68. Other means for supporting the block base 58 and engaging frame 68 can be substituted for the wheels 60 and rails.

A reverse horizontal movement of block base 58 relative to frame 68 will occur when block base 58 rounds on of the sprockets, 42 or 44. For example, as block base 58 rounds upper sprocket 42, it may move from the left side of frame 68 to the right side thereof. The movement of block base 58 and wheels 60 will cause frame 68 to reciprocate vertically. When knuckle 70 is travelling downward, the lower wheels push frame 68 downward. When knuckle 70 is travelling upward, the upper wheels push frame 68 upward. Other devices to transfer direction can be substituted for block base 58 and wheels 60. For example, a single large roller bearing coupled at its central axis to the driving system via knuckle 70 could be employed.

Because counterweight assembly 30 is coupled to frame 68, counterweight assembly 30 reciprocates with frame 68 and in turn drives belt-and-pulley system 32. Wheels 124 engage derrick structure 22 such that derrick structure 22 guides counterweight assembly 30 during reciprocation. As counterweight assembly 30 reciprocates, it operates polished rod coupling assembly 34, which is attached to the other end of belt 126.

The Improved Band-and-Pulley Lifting System

The above-described lifting system in fact achieved the objects set forth in U.S. Pat. No. 4,916,959. However, the means set forth above for coupling the ends of the belt to the counterweight and polished rod assemblies, namely, coupling assembly 80 and associated row of connector plates 82, proved incapable of supporting the significantly increased lifting capacity permitted by the belt-and-pulley system. The improved band-and-pulley lifting system of the present application not only provides improved means for coupling the band to the counterweight and polished rod assemblies, but also increases the overall capacity of the system.

Figure 3:
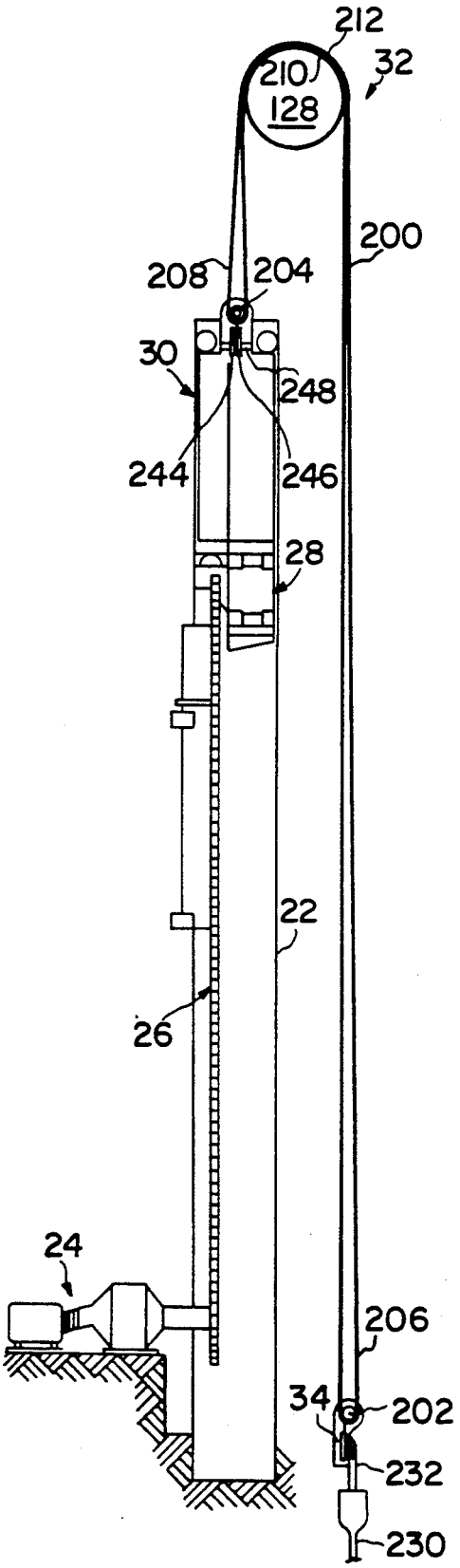
FIG. 3 depicts in simplified schematic form a side view of one embodiment of the invention, including the endless-loop band and associated end-roller assemblies, with the counterweight assembly shown in the up position.
Figure 4:
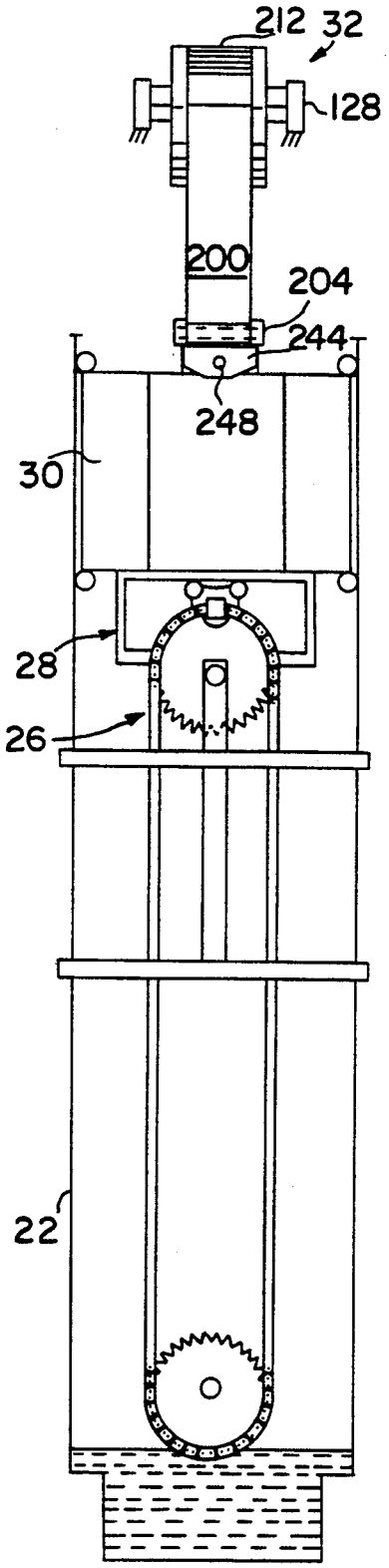
FIG. 4 depicts in simplified schematic form a rear view of the embodiment of the invention shown in FIG. 3.
Figure 5:
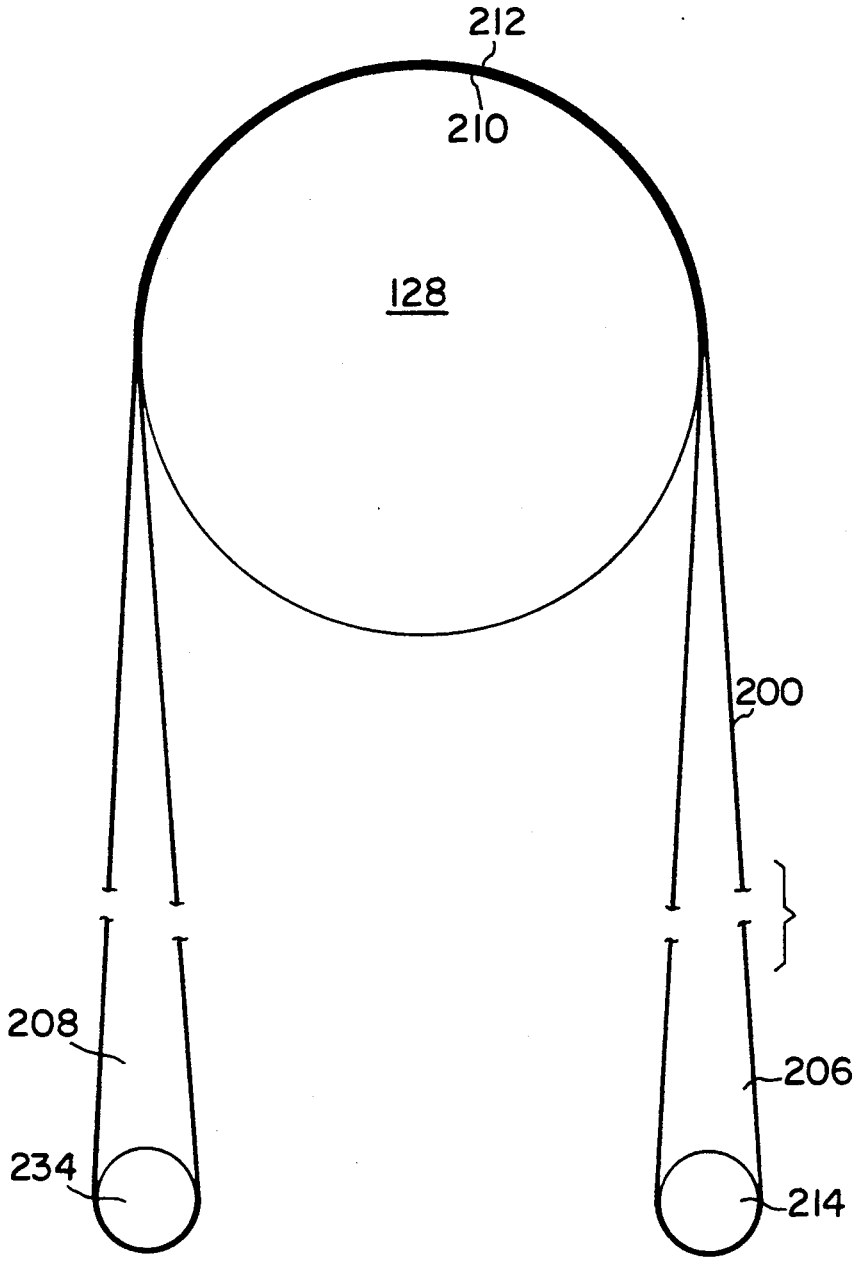
FIG. 5 depicts in simplified schematic form a side view of a preferred embodiment of the band-and-pulley system, showing the intermediate lengths draped over the central pulley and the loop ends coupled to the band shafts.

Referring specifically to FIGS. 3, 4, and 5, the improved band-and-pulley lifting system of the present invention substitutes an endless-loop band 200 for the open-ended, single-length belt 126 of the prior system. In addition, instead of a coupling assembly 80 and row of connector plates 82 to attach the counterweight and polished rod assemblies to belt 126, respective end-roller assemblies 202 and 204 ar coupled to and supported by loop ends 206 and 208 of band 200.

Figure 6:
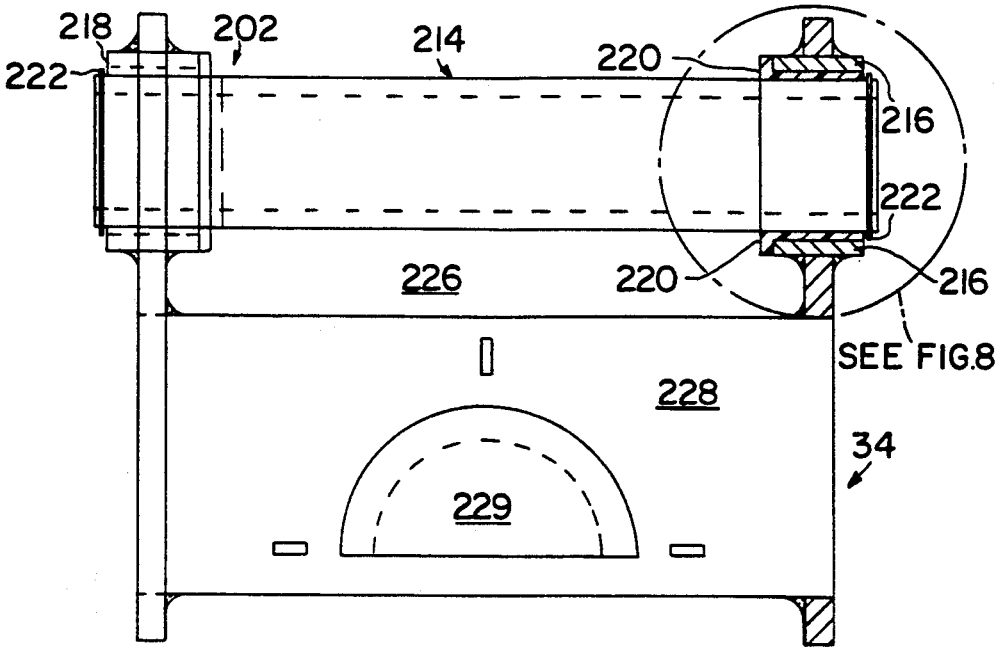
FIG. 6 depicts a preferred embodiment of the first end-roller assembly and polished rod coupling assembly.
Figure 7:
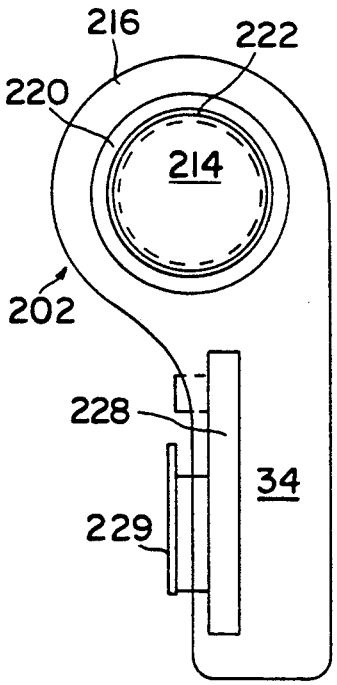
FIG. 7 depicts a side view of a preferred embodiment of the assembly of FIG. 6.
Figure 8:
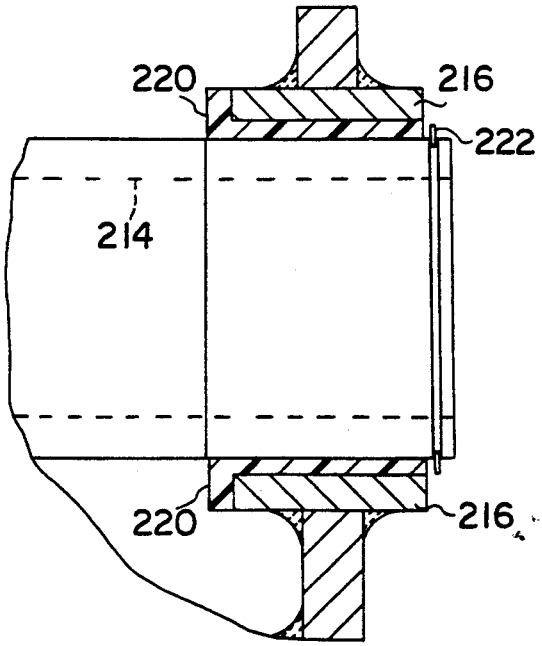
FIG. 8 is an enlarged view of the bearing assembly and shaft coupling of the end-roller assemblies.

Opposed intermediate lengths 210 and 212 of looped band 200 are draped together over central pulley 128 at or near the top of derrick structure 22. Pulley 128 may be slightly convex along its width (i.e., wider at its center) to encourage band 200 to remain centered on pulley 128. A first loop 206 at on end of band 200 is coupled to polished rod coupling assembly 34 via a first end-roller assembly 202. Referring additionally to FIGS. 6, 7, and 8, first end-roller assembly 202 comprises a band shaft 214, which is rotatably mounted in a bearing support 216. Band shaft 214 is inserted through a first bearing 218, then inside loop end 206, and then through a second bearing 220. Band shaft 214 is held in place by snap rings 222. End-roller assembly 202 is mounted on polished rod coupling assembly 34 in a manner so as to provide a longitudinal space 226 through which loop end 206 of band 200 can travel Polished rod coupling assembly 34 includes a bridle support plate 228 and bridle support 229

Figure 9:
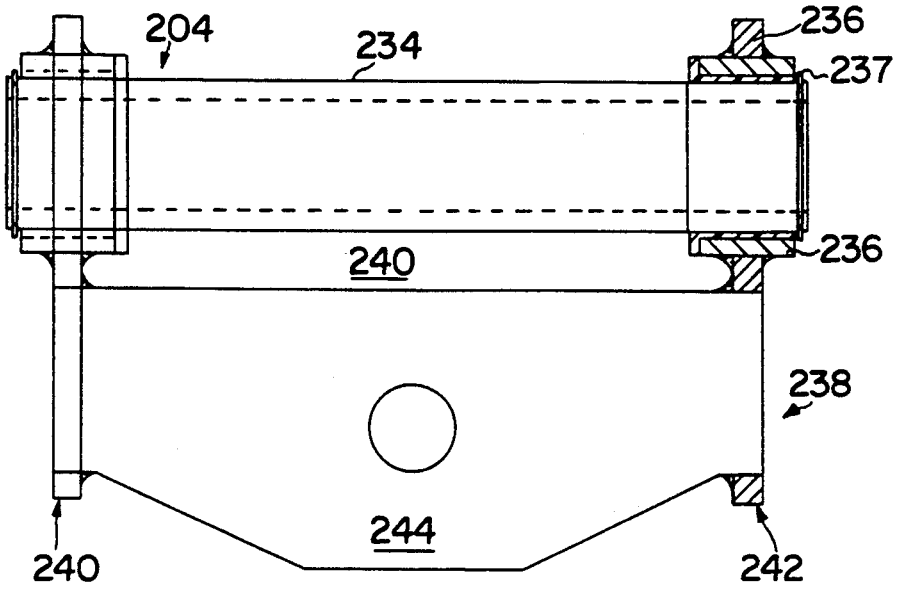
FIG. 9 depicts a preferred embodiment of the second end roller assembly and counterweight coupling assembly.
Figure 10:
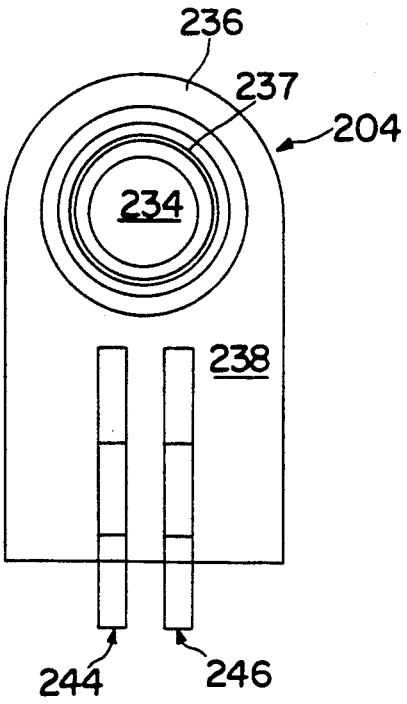
FIG. 10 depicts a side view of a preferred embodiment of the assembly of FIG. 10.

Returning to FIG. 3, polished rod 230 is supported by a bridle 232, Which is looped over bridle support 229 shown in FIGS. 6 and 7. A second loop 208 at the other end of band 200 is similarly coupled to a second end-roller assembly 204. Referring to FIGS. 9 and 10, second end-roller assembly 204 likewise comprises a band shaft 234 rotatably mounted in a bearing support 236, held in place by snap rings 237. Second end-roller assembly 204 is mounted on counterweight coupling assembly 238 so as to provide an elongated space 240 through which loop end 208 of band 200 can pass. Counterweight coupling assembly 238 includes left and right side bars, 240 and 242, respectively, which are mounted at approximate right angles to a parallel pair of front and back counterweight support plates, 244 and 246, respectively. Counterweight assembly 30 is connected to counterwe ght support plates 244 and 246 via at least one pivotable pin 248, as shown in FIG. 3.

As counterweight assembly 30 is reciprocated vertically by chain-and-sprocket assembly 26, both intermediate lengths 210 and 212 of band 200 pass over pulley 128. Referring to FIGS. 3 or 5, because the outer length 212 of band 200 is further from the center of pulley 128 than the inner length 210 of band 200, outer length 212 is forced to travel a greater distance than inner length 210 for a given amount of rotation of pulley 128. Consequently, loop ends 206 and 208 of band 200 are caused to rotate relative to their respective end-roller assemblies, 202 and 204, as the lifting action proceeds For example, as carriage assembly 28 begins to travel up the chain-and-sprocket assembly 26, causing counterweight assembly 122 to rise, central pulley 128 rotates in a clockwise direction as viewed in FIG. 5. As a result, outer length 212 of band 200 travels a greater distance in the direction of polished rod coupling assembly 34 than does inner length 210, causing band loop end 206 to travel in a clockwise direction relative to band shaft 214 as polished rod coupling assembly 34 is driven lower. In a corresponding manner, band loop end 208 travels in a clockwise direction relative to band shaft 234 as counterweight assembly 122 is driven upwards. The direction of rotation of loop ends 206 and 208 is reversed from that described above as counterweight 122 is lowered and polished rod coupling assembly 34 is raised.

It is desirable that band shafts 214 and 234 of end-roller assemblies 202 and 204 be of sufficient diameter to permit efficient rotational movement relative to band 200, as described above, thereby avoiding damage to band 200 from repeated flexing or stressing as large loads are lifted and the direction of the system is changed. For example, in a preferred embodiment, the minimum diameter for each of the band shafts 214 and 234 is suggested to be approximately 2.5 inches.

The band-drive system of the present invention offers several significant advantages over prior belt-and-pulley systems. Not only are the weak-link end connectors eliminated, but also a thinner or narrower band compared to the belt of the prior systems can be used to lift even greater loads. Thus, the band-and-pulley system of the present invention has greatly improved overall capacity.

Figure 11:
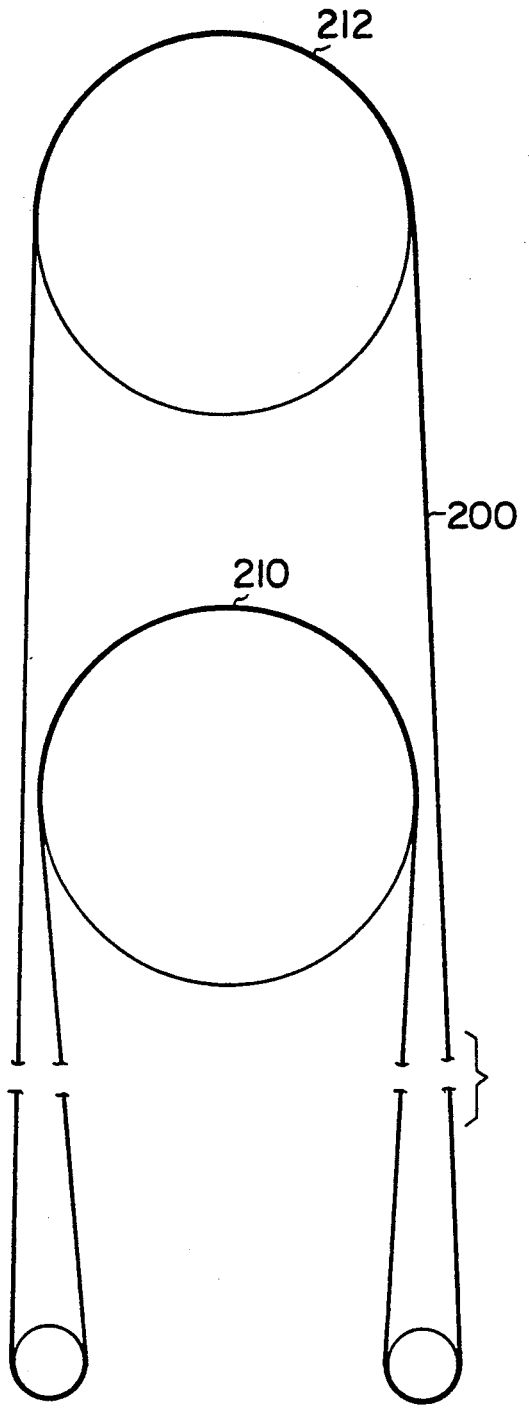
FIG. 11 depicts in simplified schematic form an alternate embodiment of the band-and-pulley system shown in FIG. 5.
Figure 12:
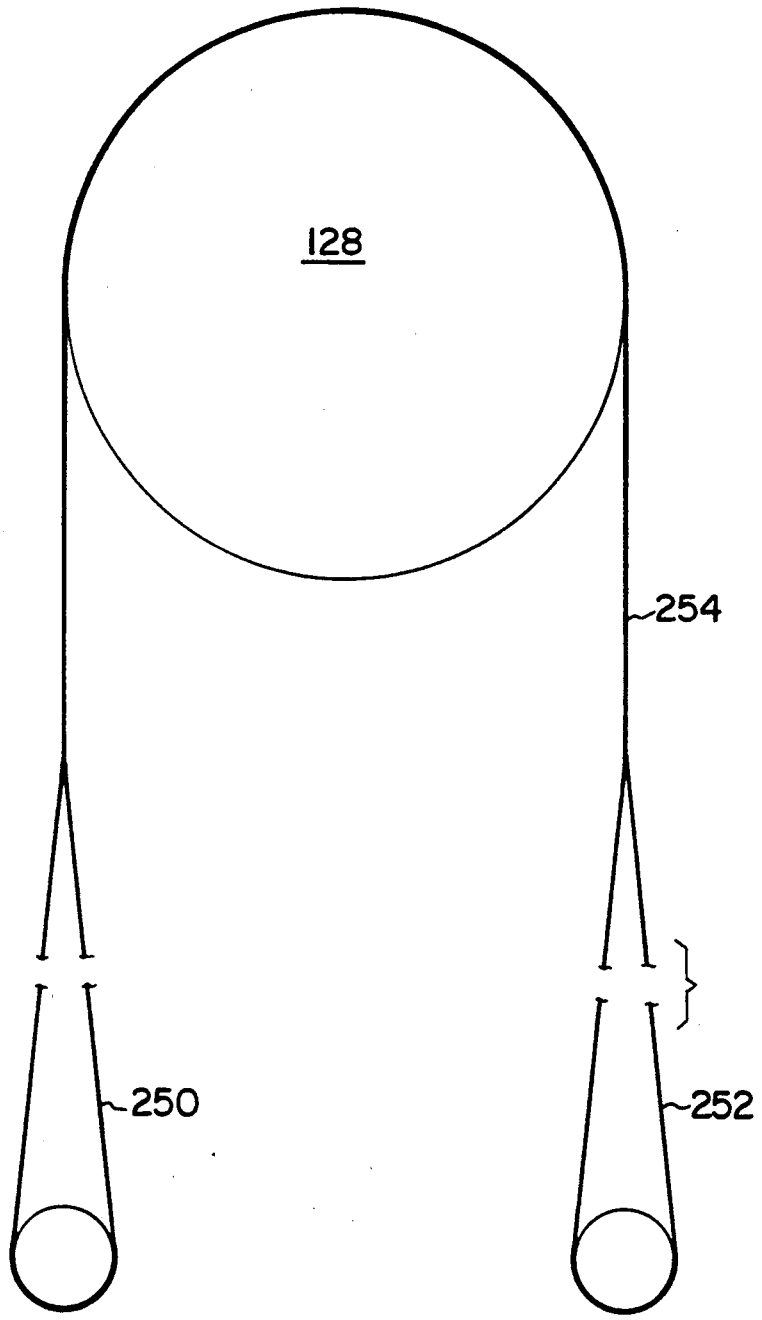
FIG. 12 depicts in simplified schematic form another alternate embodiment of the band-and-pulley system shown in FIG. 5.

It will be understood by those skilled in the art that numerous alternate forms and embodiments of the invention can be devised without departing from its spirit and scope. For example, it is envisioned that a pair of vertically spaced top pulleys can be substituted for the single pulley 128 of the preferred embodiment. By provided a pair of vertically spaced pulleys, as shown in FIG. 11, it would not be required for outer length 212 of band 200 to rest directly on top of inner length 210 as they pass over a single pulley 128. additionally, it is expected that a single-piece band, as shown in FIG. 12, could be constructed so that it comprises a pair of endless loop bands 250 and 252 coupled together by an intermediate belt length 254. In such a system, the end connections of the present invention can be used, while at the same time only one intermediate belt length 254 passes over single pulley 128. The features of the invention deemed novel are set forth below in the claims.

I claim:

1. A lifting apparatus for reciprocating a sucker-rod string coupled to an underground pump comprising:

(a) a flexible band having first and second loop ends;

(b) a first end-roller assembly coupled to and supported by the first loop end of the band;

(c) a second end-roller assembly coupled to and supported by the second loop end of the band;

(d) means for coupling a polished rod assembly to the first end-roller assembly;

(e) means for coupling a counterweight assembly to the second end-roller assembly;

(f) at least one central pulley rotatably mounted about an axis near the top of a derrick structure, the central pulley supporting an intermediate length of the flexible band; and (g) drive means coupled to the counterweight assembly for reciprocating the counterweight assembly and for causing the intermediate length of the flexible band and the central pulley to rotate about the axis of the central pulley, thereby driving the polished rod assembly.

2. The apparatus of claim 1 wherein the flexible band comprises a single elongated loop having two loop ends connected by intermediate loop lengths.

3. The apparatus of claim 1 wherein the first end-roller assembly includes a band shaft rotatably mounted in a bearing support, the band shaft operating as a pulley that is supported by and rotates relative to the first loop end.

4. The apparatus of claim 1 wherein the second end-roller assembly includes a band shaft rotatably mounted in a bearing support, the band shaft operating as a pulley that is supported by and rotates relative to the second loop end.

5. The apparatus of claim 1 wherein the means for coupling a polished rod assembly to the first end-roller assembly includes a bridle support plate coupled to the first end-roller assembly, and a bridle support mounted on the bridle support plate and supporting the polished rod.

6. The apparatus of claim 1 wherein the means for coupling a counterweight assembly to the second end-roller assembly includes a pair of relatively parallel support bars spaced apart from each other and coupled to the second end-roller assembly, a pair of relatively parallel counterweight support plates mounted at approximate right angles on the support bars, and means for pivotable attachment to a counterweight assembly.

7. The apparatus of claim 1 wherein the drive means includes:

(a) a drive motor;

(b) a gear box coupled to and driven by the drive motor;

(c) an output shaft coupled to and driven by the gear box;

(d) a lower drive wheel coupled to and driven by the output shaft;

(e) a upper idler wheel;

(f) an endless-loop connector means engaging and reciprocating about the upper idler wheel and lower drive wheel;

(g) a carriage assembly coupled to the counterweight assembly and containing upper and lower sliding surfaces, and (h) transfer means coupled to the endless-loop connector means and movably engaged with the sliding surfaces of the carriage assembly for driving the carriage assembly in alternating vertical movement as the transfer means reciprocates with the endless-loop connector means about the upper idler wheel and lower drive wheel.

8. The apparatus of claim 2 wherein the intermediate loop lengths of the flexible band are draped over and supported by the central pulley, and the first and second end-roller assemblies are movably coupled to their respective loop ends in a manner so as to allow the band proximate to each loop end to pass through an elongated space adjacent to each end-roller assembly.

9. An apparatus for lifting fluid from a subterranean location using a counterweighted sucker-rod string coupled to an underground pump and a power unit, comprising:

(a) a flexible, single-piece band having two loop ends and an intermediate section with top and bottom parts between the loop ends, (b) at least one central pulley over which the top and bottom parts of the band are draped at some portion of the intermediate section, (c) a first end-roller assembly bearing the sucker-rod string, which is supported by one loop end of the flexible band, and (d) a second end-roller assembly bearing the counterweight, which is supported by the other end loop of the flexible band.

10. The apparatus of claim 9 in which the two end-roller assemblies each comprise a roller rotatably coupled to a load-bearing support plate.

11. The apparatus of claim 9 in which the flexible, single-piece band is formed into a strip with two looped ends, wherein the top and bottom parts of the intermediate section are united.

* * * * *